US006675746B2

(12) United States Patent
Gerstmann et al.

(10) Patent No.: US 6,675,746 B2
(45) Date of Patent: Jan. 13, 2004

(54) HEAT EXCHANGER WITH INTERNAL PIN ELEMENTS

(75) Inventors: Joseph Gerstmann, Framingham, MA (US); Charles L. Hannon, Arlington, MA (US)

(73) Assignee: Advanced Mechanical Technology, Inc., Watertown, MA (US)

( * ) Notice: Subject to any disclaimer, the term of this patent is extended or adjusted under 35 U.S.C. 154(b) by 241 days.

(21) Appl. No.: 09/858,996

(22) Filed: May 16, 2001

(65) Prior Publication Data

US 2002/0050342 A1 May 2, 2002

Related U.S. Application Data

(63) Continuation-in-part of application No. 09/728,563, filed on Dec. 1, 2000.

(60) Provisional application No. 60/168,289, filed on Dec. 1, 1999.

(51) Int. Cl.[7] ..... F22B 23/06

(52) U.S. Cl. ..... 122/367.1; 122/367.3; 122/136 C; 122/155.2; 122/44.2; 165/179; 165/183; 165/109.1

(58) Field of Search ..... 122/367.1, 367.3, 122/136 C, 155.2, 44.2; 165/179, 181, 182, 183, 109.1

(56) References Cited

U.S. PATENT DOCUMENTS

| | | | | |
|---|---|---|---|---|
| 2,365,670 A | | 12/1944 | Wallace | 204/9 |
| 2,541,175 A | * | 2/1951 | Osterheld | 122/18.31 |
| 3,349,754 A | | 10/1967 | Bock | 122/17 |
| 3,648,754 A | | 3/1972 | Sephton | 159/13 A |
| 3,776,018 A | | 12/1973 | French | 72/367 |
| 3,964,286 A | | 6/1976 | Oerther et al. | 72/167 |
| 4,031,602 A | | 6/1977 | Cunningham et al. | 29/157.3 AH |
| 4,044,796 A | | 8/1977 | Smick | 138/38 |
| 4,113,009 A | | 9/1978 | Meyer et al. | 165/154 |
| 4,214,627 A | | 7/1980 | Kunkel | 165/179 |
| 4,265,275 A | | 5/1981 | Heller et al. | 138/38 |
| 4,306,619 A | | 12/1981 | Trojani | 165/179 |
| 4,327,671 A | | 5/1982 | Zimmer, Sr. | 122/44 |
| 4,344,479 A | | 8/1982 | Bailey | 165/109 |
| 4,380,215 A | * | 4/1983 | Mendelson | 122/17.2 |
| 4,383,163 A | | 5/1983 | Sjöholm | 219/107 |

(List continued on next page.)

FOREIGN PATENT DOCUMENTS

| | | | |
|---|---|---|---|
| JP | 54096466 A | 7/1979 | B21F/27/00 |
| JP | 62054537 A | 3/1987 | B21J/5/06 |
| JP | 62242794 A | 10/1987 | F28F/1/12 |
| JP | 63041790 A | 2/1988 | F28F/1/12 |
| JP | 04048194 A | 2/1992 | F28F/1/40 |
| JP | 08271169 A | 10/1996 | F28F/1/32 |
| JP | 09021593 A | 1/1997 | F28F/1/30 |

OTHER PUBLICATIONS

Bock USA Engineering Manual, Bock Water Heaters, Inc., Madison, WI (Jan. 1, 1988).

*Primary Examiner*—Jiping Lu
(74) *Attorney, Agent, or Firm*—Hamilton, Brook, Smith & Reynolds, P.C.

(57) ABSTRACT

A heat exchanger/heater comprising a tubular member having a fluid inlet end, a fluid outlet end and plurality of pins secured to the interior wall of the tube. Various embodiments additionally comprise a blocking member disposed concentrically inside the pins, such as a core plug or a baffle array. Also disclosed is a vapor generator employing an internally pinned tube, and a fluid-heater/heat-exchanger utilizing an outer jacket tube and fluid-side baffle elements, as well as methods for heating a fluid using an internally pinned tube.

31 Claims, 11 Drawing Sheets

U.S. PATENT DOCUMENTS

| | | | | | |
|---|---|---|---|---|---|
| 4,390,352 | A | | 6/1983 | Grün | 55/208 |
| 4,412,558 | A | | 11/1983 | Burke et al. | 138/38 |
| 4,442,799 | A | * | 4/1984 | Craig et al. | 122/250 R |
| 4,543,943 | A | * | 10/1985 | Gruber et al. | 122/18.1 |
| 4,554,969 | A | * | 11/1985 | Carnavos | 165/154 |
| 4,589,374 | A | * | 5/1986 | Farina | 122/18.31 |
| 4,705,106 | A | * | 11/1987 | Hornack et al. | 165/179 |
| 4,753,833 | A | | 6/1988 | Fishgal et al. | 428/36 |
| 4,860,822 | A | | 8/1989 | Sacks | 165/151 |
| 4,895,137 | A | | 1/1990 | Jones et al. | 126/391 |
| 4,971,025 | A | * | 11/1990 | Mariani | 126/101 |
| 5,070,937 | A | | 12/1991 | Mougin et al. | 165/133 |
| 5,090,369 | A | * | 2/1992 | Weng | 122/44.2 |
| 5,107,575 | A | | 4/1992 | Ishida et al. | 29/89.048 |
| 5,158,136 | A | | 10/1992 | Azar | 29/89.048 |
| 5,273,002 | A | | 12/1993 | Balint et al. | 122/20 B |
| 5,355,843 | A | | 10/1994 | Im et al. | 122/367.2 |
| 5,375,654 | A | | 12/1994 | Hougland et al. | 165/109.1 |
| 5,490,559 | A | | 2/1996 | Dinulescu | 165/148 |
| 5,516,278 | A | * | 5/1996 | Morrison | 431/171 |
| 5,655,599 | A | | 8/1997 | Kasprzyk | 165/133 |
| 5,782,208 | A | | 7/1998 | Lackstrom et al. | 122/367.3 |
| 5,845,399 | A | | 12/1998 | Dewar et al. | 29/890.03 |
| 5,913,289 | A | | 6/1999 | Gerstmann | 122/367.3 |
| 5,921,206 | A | | 7/1999 | Sams | 122/367.1 |
| 5,988,266 | A | | 11/1999 | Smith et al. | 165/78 |
| 6,095,096 | A | | 8/2000 | Vetterick et al. | 122/367.1 |
| 6,158,396 | A | * | 12/2000 | Lackstrom et al. | 122/367.3 |
| 6,286,465 | B1 | * | 9/2001 | Hughes et al. | 122/18.31 |
| 6,354,248 | B1 | * | 3/2002 | Bourke | 122/18.31 |

* cited by examiner

EVEN NUMBERED ROWS

ODD NUMBERED ROWS

HEAT EXCHANGER WITH INTERNAL PIN ELEMENTS

RELATED APPLICATIONS

This application is a continuation-in-part of U.S. patent application Ser. No. 09/728,563, filed Dec. 1, 2000, which claims the benefit of U.S. provisional application No. 60/168,289, filed Dec. 1, 1999, the entire teachings of which are incorporated herein.

GOVERNMENT SUPPORT

This invention was made with Government support under subcontact 62X-SX094C awarded by the Oak Ridge National Laboratories. The Government retains certain rights in the invention.

BACKGROUND OF THE INVENTION

This invention relates to a high-efficiency heat exchanger/heater for use in boilers, vapor generators, spa or pool heaters, engine exhaust heat recovery units, and other heat exchangers/heaters employing a relatively short, small-diameter tube.

Previous inventions have employed internal heating elements secured to the interior of the firetube to promote the transfer of heat from hot gasses flowing within the firetube through the firetube walls and into the medium to be heated. U.S. Pat. No. 5,913,289, for example, teaches a firetube heat exchanger utilizing fins formed of longitudinal corrugations. These axially aligned fins cover the inside wall of the firetube and substantially increase the internal surface area over that of the bare tube. The fins are formed out of corrugated sheet-metal brazed to the wall of the tube. To prevent the fins from overheating, the leading edge of the corrugations that would otherwise permit hot gasses to enter and flow outside the corrugations along the tube is blocked off by a ring flange brazed to the tube wall at the start of the corrugations. Hot gasses enter the space outside the corrugations adjacent to the tube through slots cut into the bases of the fins near the tube wall. The slots are sized to allow approximately half of the hot gas to pass though the slots and flow outside the corrugations, with the remainder forced to flow inside the corrugations.

U.S. Pat. No. 5,913,289 further discloses a core plug which fills the space inside the inner radius of the corrugations. The core plug forces the gas to flow near the fins, which results in a higher heat transfer coefficient. The core plug is also tapered over a length of several inches to gradually force the gas into the space between the corrugations.

While the previous invention reduces the temperatures of the fin tips, the construction of the fins results in significant thermal stress. In a fired heater, the average fin temperature is always hotter than the tube wall to which it is attached. Therefore, if the thermal expansion coefficients of the tube and fin are similar, the fin expands more than the tube. This puts the longitudinal fin in a state of compressive stress. If the stress is high enough, the longitudinal stress may cause the fin to buckle and even cause the fin-tube bond to fracture.

As an order of magnitude estimate of the compressive stress, in a case where the average fin temperature is 500° F. hotter than the tube, the thermal expansion coefficient of both the tube and the fin is $6\times10^{-6}$° $F.^{-1}$, and the elastic modulus of the tube and fin is $30\times10^{6}$ psi, since the tube is significantly stiffer than the fin, the thermal stress in the fin will be approximately 90,000 psi. This is generally greater than the yield stress.

The state of the stress is strongly affected by the state of pre-stress between the tube and fin. The corrugated fins are generally brazed to the tube wall. If the thermal expansion coefficient of the tube is slightly less than that of the fin, as would be the case if the tube material was carbon steel and the fin was ferritic stainless steel, then upon cooling from the brazing temperature the fin would contract more than the tube. At room temperature, the fin would be pre-stressed in tension at a level close to the yield stress. This tensile pre-stress would greatly reduce the net compressive stress at operating temperature.

Such has been the case with previous fired vapor generators for absorption heat pumps, where the tube is made of carbon steel and the fins are ferritic stainless steel. However, when the tube is also made of stainless steel, which may be required for resistance to corrosion by the working fluid of the heat pump, the state of pre-stress is either compressive (tube expansion coefficient greater than that of the fin) or the degree of tensile pre-stress is insufficient to overcome the greater amount of thermal expansion in operation (fin thermal expansion coefficient greater than or equal to that of the tube).

The corrugated fin firetube achieves high heat absorption efficiency in a relatively short length by virtue of its small passage size, which provide a small "hydraulic diameter" conducive to high heat transfer coefficients. However, the same small passage size can be fouled by debris larger than relatively small particle size. A larger passage size, i.e. a wider corrugation pitch, would be less subject to fouling but would significantly reduce the heat transfer coefficient, requiring a longer firetube.

SUMMARY OF THE INVENTION

The present invention generally relates to a durable, high-efficiency tubular heater/heat exchanger, such as a firetube heater, generally comprising a tubular member having a fluid inlet end, a fluid outlet end, and a plurality of closely-spaced pin elements bonded to the inside wall of the tube. The present invention may additionally comprise a source for producing heat transfer fluid, including high-temperature gasses, in fluid communication with the fluid inlet end of the tube. During operation, the heat-transfer fluid flows from the fluid inlet end through the tube and through the array of pins. The flow of the fluid is generally parallel to the heat transfer surface, i.e. the tube wall, and perpendicular to the longitudinal axes of the pins. The passageway between adjacent pins is generally large enough to prevent fouling by small particles in the fluid. In addition, since the pin length is usually much greater than its diameter and the temperature gradient of the pins is mostly axial, i.e. from the tip to the base, there is relatively little thermal stress induced in either the pin or the tube, even when the pin is considerably hotter than the tube.

In some embodiments, the source of the heat-transfer fluid may be an internal source, such as a burner secured to the tube at the fluid inlet end. The heat exchanger may also utilize an external source to produce the heat transfer medium.

According to another aspect of the invention, a blocking member is disposed concentrically within the interior core area of the tube defined by the tips of the pins. In one embodiment, the blocking member comprises a core plug which prevents the heat transfer fluid from by-passing the pins, thus increasing thermal effectiveness. The core plug can be tapered to provide a large flow cross-sectional area at the entrance of the pinned array which gradually decreases as the gas flows through the tube. This configuration is useful in, for instance, cooling high-temperature gases to an intermediate temperature before they are forced by the core plug to flow exclusively through the pinned area.

According to another aspect of the invention, the blocking member comprises a series of metal baffles disposed longitudinally along the interior core area of the firetube. The baffles periodically force the heat transfer fluid to flow through the pins. The shape of the metal baffles is not critical; in some embodiments, the baffles block only a portion of the fluid while permitting some of the fluid to flow through. With the baffle array of the present invention, the heat transfer fluid is repeatedly mixed in the areas between the baffles, resulting in a more uniform temperature.

The pins of the present invention generally have a thick cross-sectional area in order to increase conductance and thus prevent overheating. This permits the pins to be made from an inexpensive material of relatively moderate thermal conductivity while obtaining high conductance along the pins. In certain embodiments, the pins comprise carbon steel studs. These studs provide good thermal matching with a conventional carbon steel firetube. In addition, carbon steel pins can be utilized in a stainless steel firetube without incurring excessive thermal stress.

It is a further advantage of carbon steel pins that they can be readily and inexpensively attached to the interior of the tube by means of an arc welding process commonly known as "stud welding." The welding process can be easily automated with programmed positioning, feeding and welding of studs. There is no requirement for a brazing alloy, which would involve time-consuming and labor intensive braze preparation, the use of costly braze alloy, and the potential of corrosion of the braze alloy by the heat transfer medium.

In another aspect of the present invention, a heat exchanger comprises a tube with an interior diameter between 3.5 and 4.25 inches, a fluid inlet end, a fluid outlet end, and a plurality of pins having a diameter between 5/16 inch and 7/16 inch and a height between 5/8 inch and 1 inch, where the pins are bonded to the interior wall of the tube.

In yet another aspect of the present invention, a vapor generator comprises a tubular member as described above jacketed by a fluid to be heated. The fluid to be heated is admitted into an annulus formed between the exterior of the tube and the interior of a concentric shell surrounding the length of the tube and attached to both ends of the tube. During operation, heat from the high-temperature gas flowing inside the tube is transferred by the pins and the interior of the tube to the exterior of the tube, and ultimately to the fluid contained within the annulus.

According to another aspect, a fluid heater/heat exchanger comprises a tubular heater/heat exchanger as described above, where the tube is disposed concentrically within a larger diameter outer jacket tube. The outer jacket tube is secured to the interior tube at the fluid inlet end and the fluid outlet end, by, for example, a pair of ring flanges. The exterior of the inner tube and the interior of the outer jacket tube define an annulus for containing a fluid to be heated. The outer jacket tube further contains an inlet port for admitting a fluid to be heated to the annulus, and an outlet port for discharging heated fluid from the annulus. The annulus contains at least one baffle element, such that fluid within the annulus is directed by a baffle element to flow in one or more channels.

In one embodiment, the baffle element comprises a helical baffle wound around the exterior of the interior tube to define a helical flow channel between the turns of the helix and the inner and outer tubes.

According to another embodiment, the baffle element comprises a series of longitudinal baffles defining longitudinal flow channels along the length of the interior tube. The direction of flow for each channel can be alternated so that the fluid flows along the length of the interior tube in a first direction, and then flows back in the opposite direction in an adjacent channel. With an even number of longitudinal channels, the input and output ports can be located adjacent to one another at the same end of the outer jacket tube.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. Of the drawings.

DETAILED DESCRIPTION OF THE INVENTION

Figure 1A:
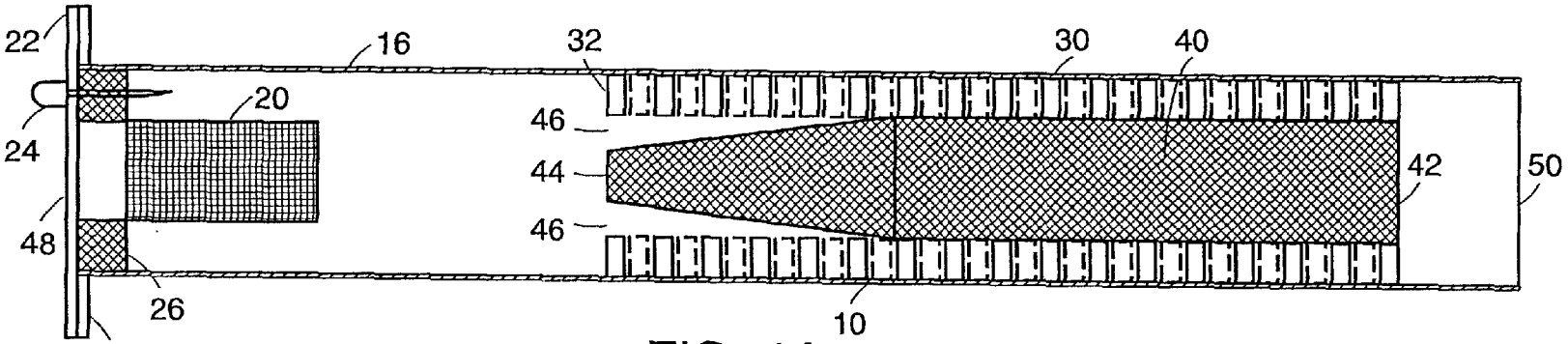
FIG. 1*a* is a longitudinal sectional view of a tubular heat exchanger/heater containing a burner in accordance with one embodiment of the present invention.

Turning now to the drawings, a tubular heat exchanger/heater constructed according to the principles of the present invention is illustrated in FIG. 1*a*. Tubular member 10 contains a fluid inlet end 48 and fluid outlet end 50 for input and output of a heat transfer medium. In the particular embodiment illustrated, a burner 20 is secured to the fluid inlet end 48. Burner 20 is attached to flange 22, which mates with flange 12 of tube 10. Flange 22 is insulated from burner 20 by refractory insulation ring 26. Burner 20 is supplied with a combustible air/gas mixture by an inlet conduit, not shown. During operation, the combustible mixture is ignited by igniter 24, and the burner 20 produces hot gas.

Burner 20 is contained within an unpinned section 16 of the tubular member 10. Following the unpinned section 16, an array 30 of pins 32 is attached to the inner wall of the tube 10. The pins 32 project inwardly into the tube 10 and the tips of the tube define an interior core area of the tube 46. A blocking member is disposed within the interior core area 46. In the present illustration, the blocking member consists of a core plug 40. Core plug 40 contains a cylindrical section 42 and a conical section 44 at the entrance to the array of pins 30.

In operation, combustible gases are supplied to burner 20, and combustion is effectively completed in unpinned section 16. The hot gas flows through the tube 10, and is forced by core plug 40 to flow over pins 32, exiting from the fluid outlet end 50.

Figure 1B:
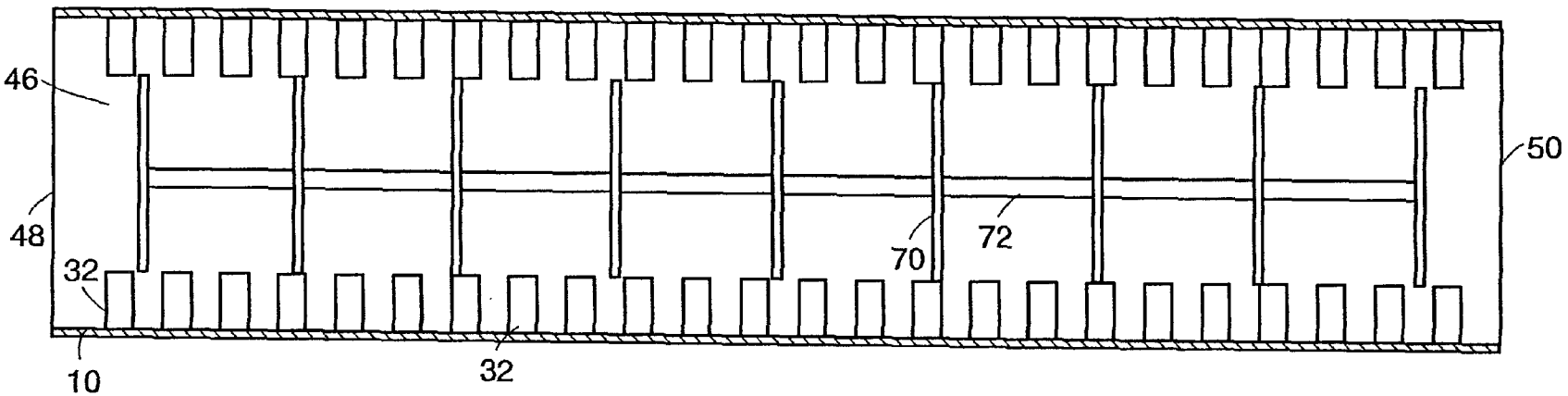
FIG. 1*b* is a longitudinal sectional view of a tubular heat exchanger/heater employing an external heat source in accordance with another embodiment of the present invention.

An alternative configuration of the heat exchanger/heater of the present invention is illustrated in FIG. 1*b*. Tubular member 10 again contains a fluid inlet end 48 and fluid outlet end 50 for input and output of a heat transfer medium. In this embodiment, the heat source comprises an external heat source (not shown), producing the high-temperature gas, in fluid communication with the fluid inlet end 48 of the tubular member. The external heat source could comprise, for instance, an internal combustion engine, where the hot gas comprises exhaust products from the engine. Alternatively, the external heat source could comprise one or more primary fluid heaters, with the heat exchanger of the present invention serving as a secondary heat recovery means to extract additional energy from partially-cooled flue gas.

In the heat exchanger/heater illustrated in FIG. 1*b*, the pin array 30 may comprise an array of pins 32 spaced more-or-less evenly along the entire length of the tube 10. With this configuration, there is no need for an unpinned section, as there is no combustion occurring within the tube, and the pins may be disposed as close to the fluid inlet end of the tube as practicable.

The heat exchanger/heater shown in FIG. 1*b* additionally comprises a blocking member disposed in the internal core area of the tube that is defined by the tips of the pins. In this illustration, the blocking member comprises a series of metal baffles 70 joined by connecting means 72, disposed in the interior core area 46 of the tube 10. Alternatively, the blocking member may comprise a core plug, as illustrated in FIG. 1*a*.

Figure 2B:
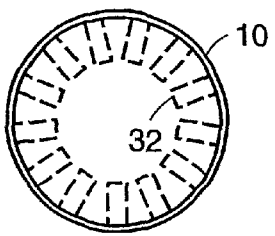
FIG. 2*b* is a cross-sectional view of the tube of FIG. 2*a* illustrating an even-numbered row of pins.
Figure 2A:
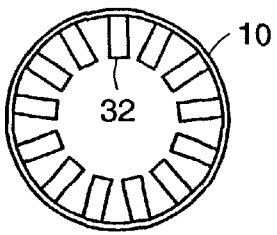
FIG. 2*a* is a cross-sectional front view of a tubular heat exhanger/heater of the present invention illustrating an odd-numbered row of pins, the pins attached to the interior of the tube in a circular array.
Figure 2C:
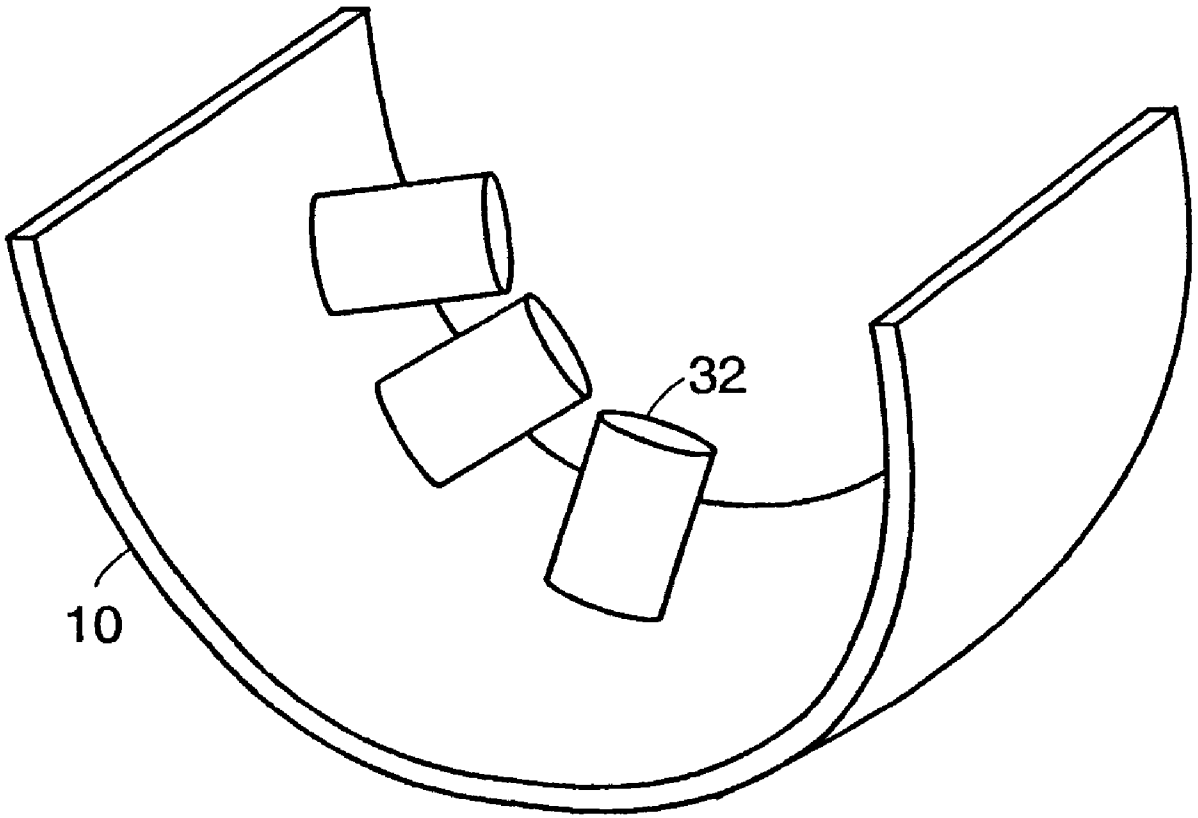
FIG. 2*c* is a partial perspective view of the interior wall of a tube to which a plurality of heat exchange elements are bonded in accordance with one embodiment of the present invention.

According to one aspect of the present invention, internal pins are employed to increase the interior surface area of the tube. FIG. 2*c* illustrates a partial perspective view of the inside of a firetube with a pin 32 secured to the interior wall of the tube 10. The pins do not need to be made from a material with a thermal expansion coefficient that is similar to the coefficient of the tube material.

In one embodiment, both the tube and the cylindrical pins are made from carbon steel, although the pins may be copper washed. Carbon steel is less expensive than other candidate materials for the pins, such as ferritic stainless steel.

In some cases, however, it may be advantageous to use a tube made of stainless steel. This may be necessary in a vapor generator for an absorption heat pump, for instance, in order to resist corrosion by the working fluid. With the present invention, inexpensive carbon steel studs can still be used with a stainless steel tube without being subject to the high thermal stresses found in prior systems.

The use of cylindrical or polygonal parallelopiped pins is also advantageous over prior systems in that the pins can be readily, durably and inexpensively attached to the interior of the tube by means of an arc welding process commonly known as "stud welding." In this process, a short-duration arc is drawn between the base of the pin/stud and the surface to which it is to be bonded. The arc locally melts the base of the pin/stud and the surface opposite the base of the pin/stud. The pin/stud is then driven into the melted pool, which rapidly solidifies. No brazing alloy is required.

As commonly applied, a hand-held stud-welding gun is held up to a surface. The gun is supplied with power by a high-voltage power supply, which may be either an arc-welded or a capacitor-discharge type. The gun feeds a stud and the power supply sequences the arc and triggers driving of the stud into the melt pool. The process is easily automated with programmed positioning, feeding, and welding of studs. It requires little energy, and results in low heating or distortion of the base material to which the pins/studs are welded. Typically, the system is capable of driving 20 to 30 studs per minute.

Using an automated stud welding process, an offset stud welding gun may be positioned inside the tubular member. The tube is indexed axially and rotationally to apply the studs in a desired pattern.

Those skilled in the art will recognize that any suitable means for securing the pins, now known or later developed, may also be employed.

The arrangement of pins illustrated in FIG. 1*a* consists of alternating rows of pins in circular arrays, indexed such that each successive pin is positioned in between the pins of adjacent rows. This arrangement is further illustrated in FIGS. 2*a* and 2*b*, which show the arrangement of even and odd numbered rows.

Figure 3A:
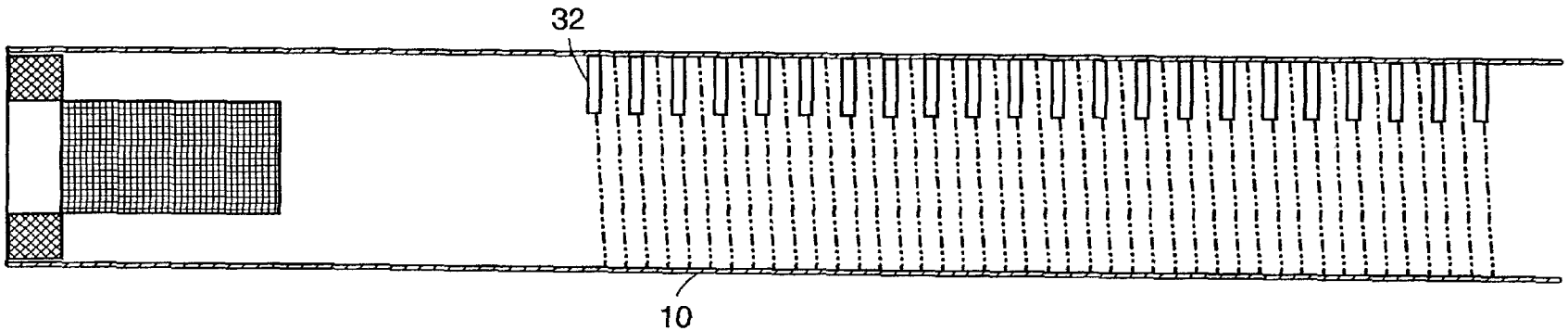
FIG. 3*a* is a cross-sectional side view of a tubular heat exchanger/heater in accordance with one embodiment of the present invention illustrating a helical array of pins.
Figure 3B:
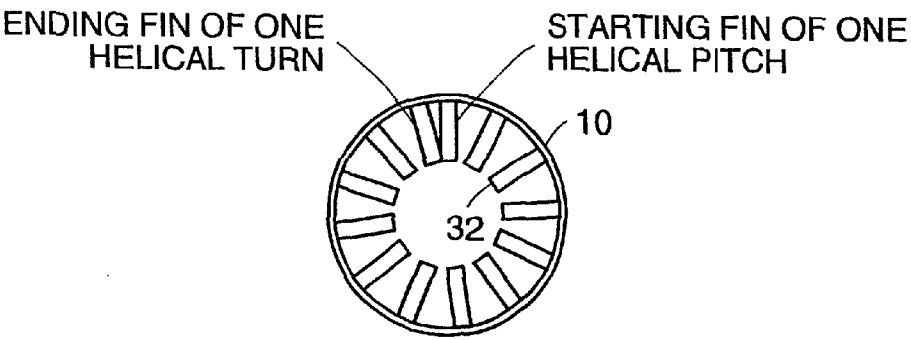
FIG. 3*b* is a cross-sectional front view of the tube of FIG. 3*a;*

Instead of arranging the pins in circular rows, the pins may also be arrayed in a helical pattern, as illustrated in FIGS. 3*a* and 3*b*. A helical arrangement is preferred in production, as it permits a repetitive indexing of the pin attachment means from start to finish. The angular pitch of the pins along the helix is selected such that the number of pins per turn of the helix is an integer plus one half. This results in each pin being positioned in between the pins of adjacent rows.

Turning now to the design of the pins, in one embodiment the pins have a substantially circular cross-section. However, the shape of the pins is not critical. Other designs, such as polygonal pins, may also be employed. Generally, though, the aspect ratio of the cross-section of the pin should be close to unity.

Furthermore, the pins of the present invention are selected to possess sufficient cross-sectional thickness to increase thermal conductance and thus avoid overheating. For instance, in the case of a firetube heater, the gasses entering the pinned area of the firetube may be in excess of 2500° F. In order to prevent overheating, the maximum temperature of carbon steel pins should not exceed about 900° F. By utilizing pins having a sufficient thickness, the thermal conductance along the length of the pin and into the tube wall is increased relative to the heat transferred to the surface of the pin. A firetube according to the present invention with a heat input of 90,000 Btu/h is able to achieve approximately 98% thermal effectiveness at a pressure-drop of 1.5 to 2.5 inches of water column without the peak pin temperature exceeding 900° F. Using an alternative design such as radial fins with a thin rectangular cross-section, it is believed that the peak temperature of the fins would exceed the scaling temperature for mild steel under these same conditions.

Despite the thick cross-section, the length of the pins of the present invention is still much greater than the diameter and the temperature gradient is mostly axial (i.e. from the tip to the base). Generally, with the height and diameter aspects of the pins of the present invention, there is relatively little thermal stress induced in either the pin or the tube, even when the average temperature of the pin is significantly hotter than the tube.

The pins of the present invention are also designed so that the direction of flow of the heat transfer medium is substantially parallel to the internal surface of the tube and perpendicular to the longitudinal axis of the pin. The unity aspect ratio of the pins means that the pins will generally not deflect the flow of the heat transfer fluid in a direction perpendicular to the axis of the tube. Unlike the case of flat fins, the pins of the present invention prevent any substantial swirl component from forming as the fluid flows through the tube. The hottest fluid thus remains close to the heat transfer area, rather than in towards the center of the tube. The pin array of the present invention, coupled with the blocking means discussed below, increases thermal effectiveness by forcing hot gas to flow near the interior wall of the tube.

In addition to providing increased surface area for contacting the heating medium and transferring heat to the heat transfer surface, the pin array of the present invention also results in an area between pins through which the heated gas may flow longitudinally through the tube to the outlet end 50. The space between adjacent pins can be modified for a given firetube to decrease/increase the size of the passageways. The size of the passageways affects both the thermal effectiveness and the pressure-drop of the tube when firing. With the pin array of the present invention, the annular passageways are large enough to minimize blocking of the gas flow by particles and debris settling in the pinned area.

In general, the design of the pins and the pin array should be selected to achieve the highest possible heat absorption efficiency in the shortest firetube length with the least flue-gas pressure-drop. The pins themselves should be cylindrical or polygonal, with the major axis lying substantially perpendicular to both the interior tube wall and the longitudinal axis of the firetube. As illustrated in FIG. 2*c*, the tips of adjacent pins should be as close together as possible. Practically speaking, the tip space between adjacent pins is limited to approximately one-eighth inch, which is the minimum clearance required for holding the studs in place using currently-known welding processes.

The pin length should be substantially less than the interior radius of the tube, as longer pins must be located farther apart at the base which will reduce overall surface area. A preferred range of pin lengths is between approximately 30 and 50 percent of the interior radius of the tube. In addition, the pin diameter must generally also be increased with an increase in pin length, so as to prevent the tips of the pins from overheating during operation. A preferred aspect ratio of pin length to diameter for carbon steel pins is approximately 2:1.

Turning now to another aspect of the invention, a blocking member is employed to control the flow of the heat transfer medium through the tube. As shown in FIG. 1*a*, the tips of the pins 32 define an interior core area 46 of the tube. In one embodiment of the present invention, core plug 40, made of a heat resistant material, is disposed in the interior core area 46 and contacts the tip ends of the pins 32. During operation, core plug 40 forces the heat transfer fluid out towards the interior wall of the tube where the pins are located.

According to another embodiment, the core plug is tapered over a length of several inches at the entrance to the pins so that the hot gasses are gradually forced to flow through the area containing the pins. As illustrated in FIG. 1*a*, the core plug 42 comprises a truncated cone, having a cylindrical section 42 for a base and a conical section 44 facing the fluid inlet end 48 of the tube.

Figure 4:
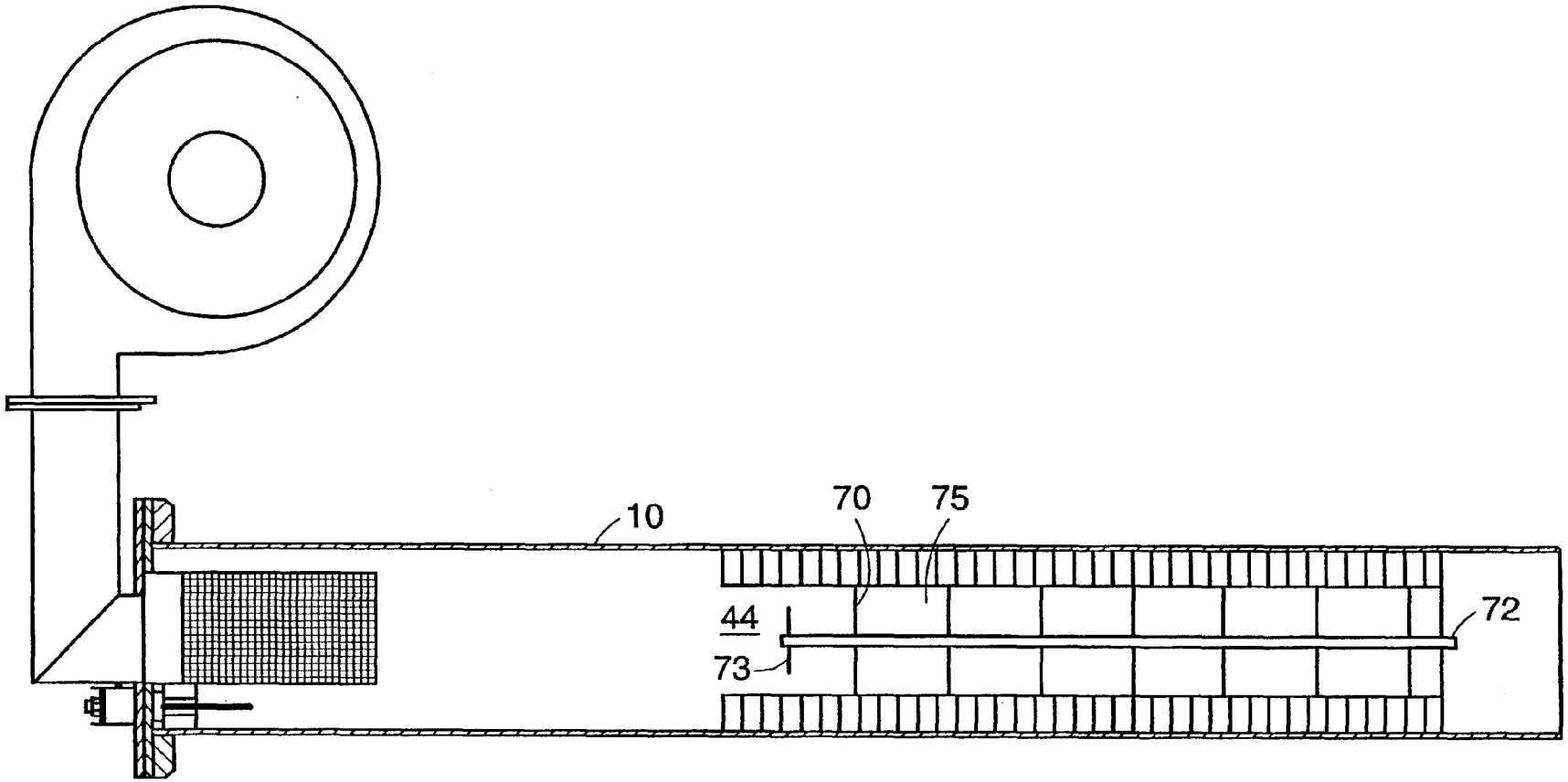
FIG. 4 is a cross-sectional side view of a tubular heat exchanger/heater with a baffle array in accordance with another embodiment of the present invention.

A further embodiment of the present invention is illustrated in FIG. 4. In this embodiment, the blocking member comprises a series of metal baffles 70 disposed along the interior core area 46 of the tube 10. The baffles are preferably joined together by a connecting means 72, such as a metal rod, to support the baffles and permit them to be easily installed and removed from the tube. The baffles are generally aligned to block at least some of the heat transfer fluid flowing through the interior core area of the tube. The baffles may be aligned, for instance, substantially perpendicular to the longitudinal axis of the tube. They are generally spaced between 1 and 3 inches from one another along the longitudinal axis of the tube, the space between adjacent baffles thus defining an empty chamber 75 of the interior core area 46.

The metal baffles may comprise a series of plates or disks that periodically completely block the interior core area of the tube. As the heat transfer fluid flows through the tube and contacts the baffles, it is repeatedly forced to flow through the area containing the pins, and is also forced to mix radially.

The shape of the baffles is not critical. In some embodiments, the baffles are shaped so that they will block only a portion of the heat transfer fluid, and allow the remainder of the fluid to flow unobstructed into the next chamber. Each baffle should block between approximately 50 and 100 percent of the cross-sectional area of the interior core of the tube. The baffles closest to the fluid inlet end of the tube, and in particular the leading baffle 73, may be smaller than this in order to gradually force the fluid through the pins. In this sense, smaller baffle(s) close to the fluid inlet end operate much like the tapered end of the core plug, discussed above.

The effect of using the baffle array of the present invention is that the heat transfer fluid is mixed in the chambers between adjacent baffles, resulting in a more uniform temperature. By employing mixing baffles, a high thermal effectiveness can be attained without the need to completely block the core of the tube The shapes of the baffles should be selected for optimal performance of the heater. It will be understood by those skilled in the art that greater blockage of the interior core of the tube will result in higher thermal effectiveness, but also increased pressure-drop.

The baffles can be selected to have virtually any shape-e.g. disk-shaped, semi-circular, triangular, polygonal, H-shaped, etc. The baffles should be made from a material that can safely operate at temperatures up to approximately 1700° F., such as a Nickel bearing heat resistant alloy. In one preferred embodiment, the entire baffle array comprises a single unit fabricated from sheet metal. The metal can be cut and folded to form both the baffle elements, as well as the connecting means, when disposed in the tube.

Figure 5A:
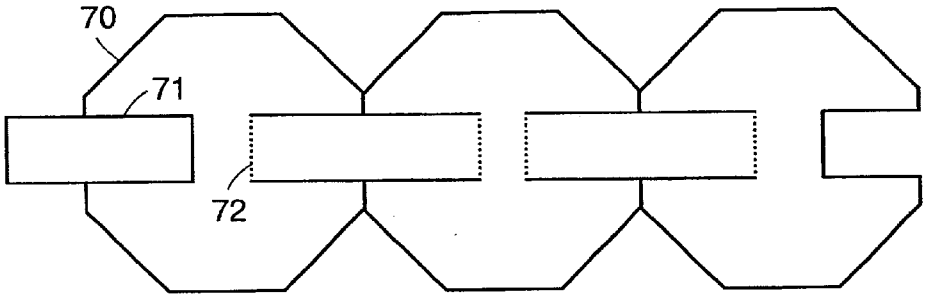
FIG. 5*a* is a top view of a sheet metal piece cut to form a baffle array of the present invention.
Figure 5B:
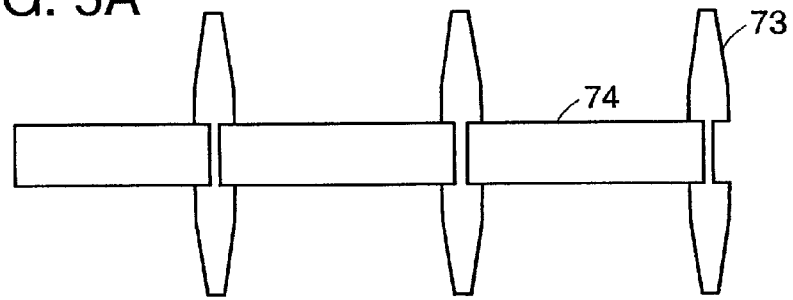
FIG. 5*b* is a front and side view of the sheet metal piece of FIG. 5*a* folded to form a baffle array of the present invention.
Figure 5C:
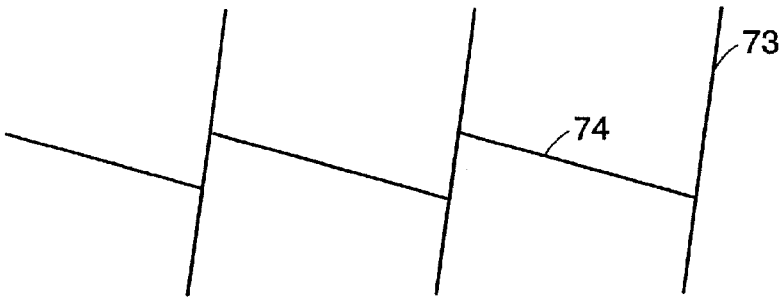
FIG. 5*c* is the baffle array of FIG. 5*b* rotated by 90° along the longitudinal axis.
Figures 1, 5B:
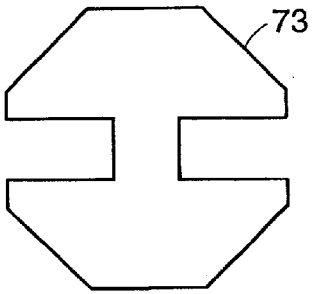
Figures 1, 5C:
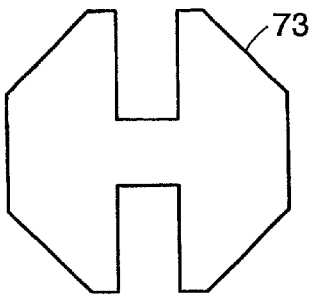

One such baffle array is illustrated by FIGS. 5*a*, 5*b* and 5*c*. FIG. 5*c* shows a cut sheet metal piece 70, where the cuts are represented by solid lines 71. To form the baffle array, the metal piece is folded along the dotted lines 72. FIG. 5*b* shows the folded array comprising the baffles 73 and the connecting means 74. In FIG. 5*c*, the baffle array has been rotated by 90°. It should also be understood that the connecting means may be twisted so that the baffles are given different orientations relative to one another.

In one exemplary embodiment of the present invention, a firetube heater as shown in FIG. 1*a* has a length of approximately 30 inches, an internal diameter between 3½ and 4¼ inches, and a heat input between 50,000 and 100,000 Btu/h. The pins 32 comprise carbon-steel studs having a diameter in the range of 5/16 inch to 7/16 inch and a length between ⅝ inch and 1 inch. The pinned array 30 is approximately 16 inches long. The blocking member comprises a core plug 40, located concentrically within the pinned array 30. The plug 40 comprises a cylindrical section 42, completely filling the interior core area 46 of the firetube, and a conical section 44 gradually filling the interior core area 46 over a length of about 6 inches.

It will be understood from the above discussion that the pins can be secured in a circular array, as illustrated in FIG. 1*a*, a helical array, as shown in FIGS. 3*a* and 3*b*, or in any other suitable manner. It will also be understood that the blocking member may comprise a core plug 40, as shown in FIG. 1*a*, a series of metal baffles 70, as shown in FIG. 4, or any other suitable means for blocking the flow of the hot gas.

The firetube according to this embodiment includes a burner 20 and an unpinned length 16 comprising a combustion chamber. For burners of the premixed gas-type, an unpinned volume of approximately 0.0015 $in^3$/Btu/h is sufficient to permit oxidation of carbon monoxide before quenching the reaction in the heat exchanger. It will be understood, though, that the firetube of the present invention need not contain an internal burner. FIG. 1*b*, for instance, illustrates a firetube utilizing an external heat source. In this case, there is no need for an unpinned section of tube, and the pinned area can extend the entire length of the tube.

The dimensions of the pins and their arrays for heat inputs of 60,000 Btu/h and 90,000 Btu/h, (corresponding approximately to 3-RT and 5-RT absorption heat pumps, respectively), are shown in the table below. Such designs achieve a thermal effectiveness of approximately 98% at a pressure-drop of 1.0 to 2.5 inches of water column, with a peak pin temperature under 900° F.

| | | | |
|---|---|---|---|
| Firing Rate | Btu/h | 60,000 | 90,000 |
| Firetube Diameter | in | 4.01 | 4.01 |
| Pin Diameter | in | 0.38 | 0.38 |
| Pin Height | in | 0.80 | 0.80 |
| Number of Rows | | 30 | 37 |
| Number of Pins | | 435 | 540 |

Figure 6:
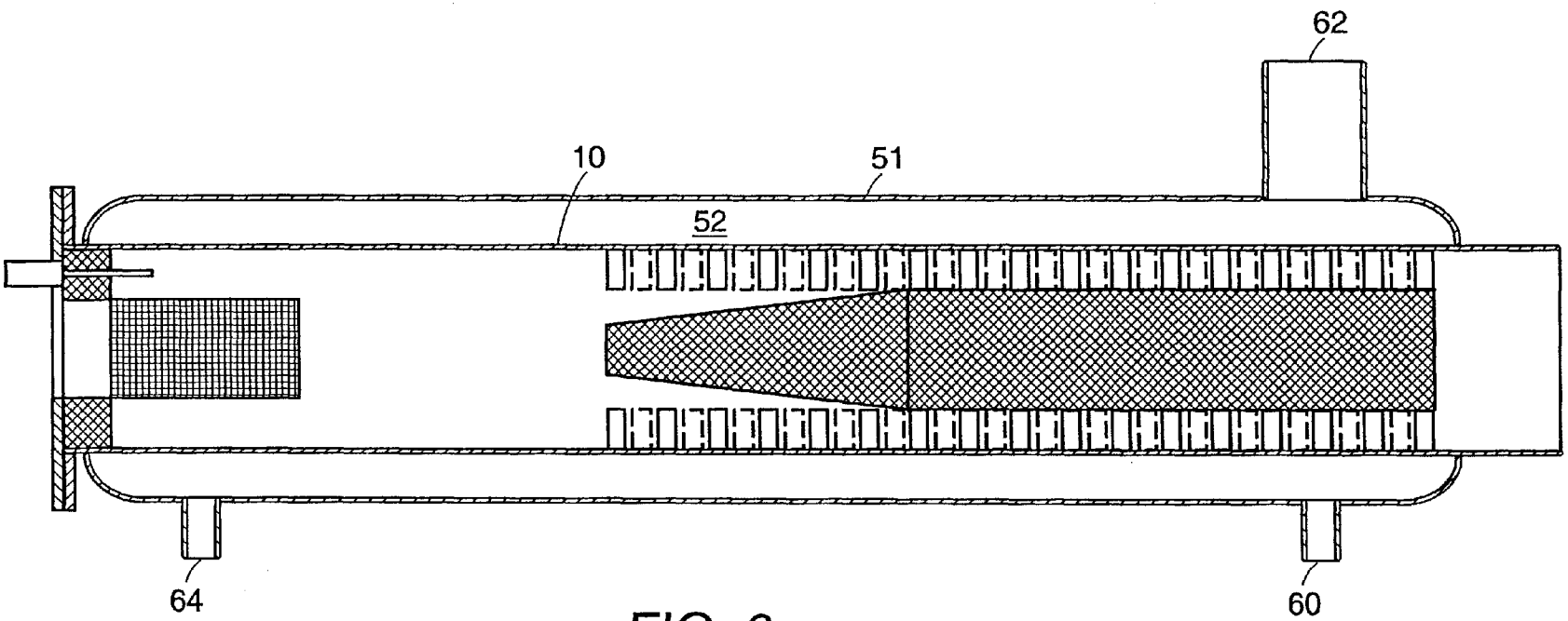
FIG. 6 is a cross-sectional side view of a fluid heater/vapor generator in accordance with another aspect of the present invention.

Turning now to FIG. 6, a fluid heater or vapor generator according to the present invention is shown. A concentric shell 51 is attached to tube 10, by conventional means, such as welding. A firetube heater with an internal burner secured to the fluid inlet end, such as the firetube illustrated in FIG. 1*a*, is operated to generate heat. Alternatively, a tubular heater utilizing an external heat source, such as the heater shown in FIG. 1*b*, may also be employed. A fluid to be heated is contained within the annulus 52 formed between the concentric shell 51 and tube 10. Liquid is admitted to the annulus 52 through nozzle 62, vapor exits through nozzle 62, and depleted liquid is discharged through nozzle 64.

Figure 7:
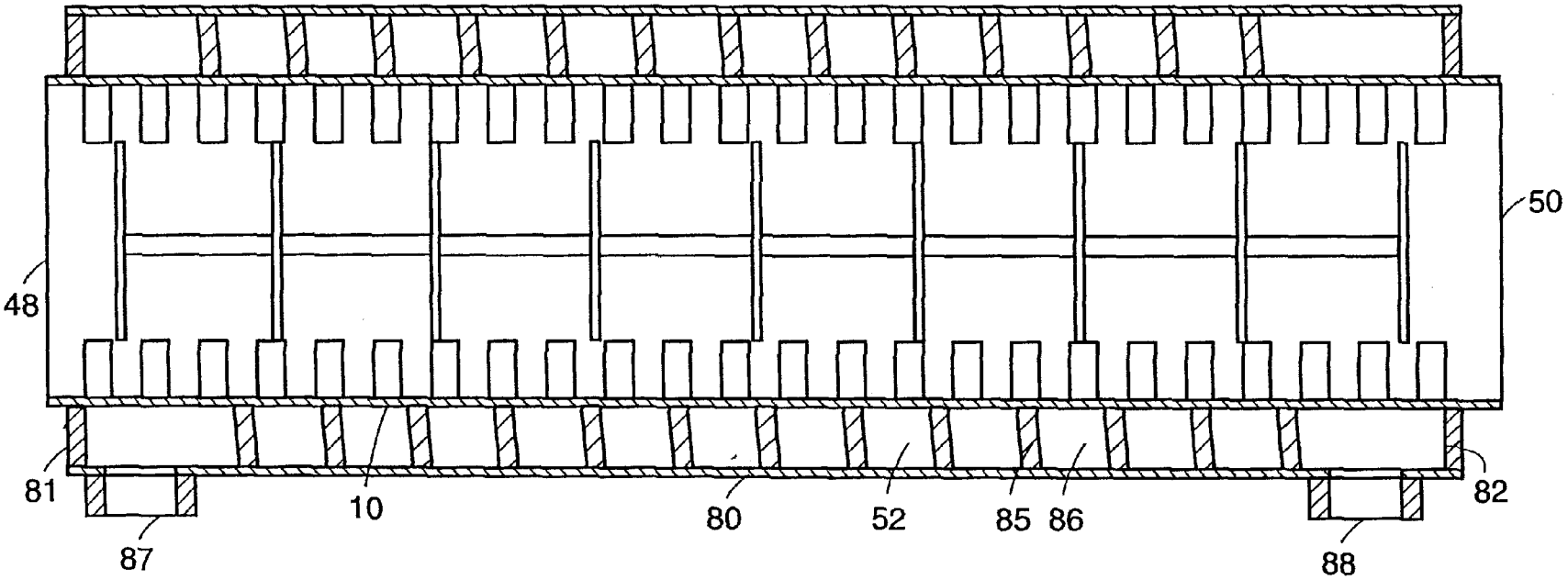
FIG. 7 is a cross-sectional side view of fluid heater/heat exchanger with fluid-side helical baffle according to the principles of the present invention.

FIG. 7 illustrates an alternative configuration for a fluid heater/heat exchanger according to the principles of the present invention. According to this embodiment, an outer jacket tube 80 surrounds tubular member 10 in a concentric manner to form an annulus 52 between the outer surface of the interior tube and the interior wall of the outer jacket tube. Ring flanges, 81 and 82, may be secured by conventional means to seal both ends of the annulus. The jacket tube additionally comprises an inlet fitting 87 for admitting fluid to be heated into the annulus, and an outlet fitting 88 for discharging heated fluid from the annulus.

A helical baffle 85 is wound around the outside of tube 10, such that, when the outer jacket tube is secured to the interior tube, channels 86 are formed in the space between adjacent turns of the helix and the inner and outer tubes. Alternatively, the helical baffle may be secured to, or integral with, the inside surface of the outer jacket tube.

Fluid to be heated is circulated by a pump (not shown) into the annulus through inlet 87 and out of the annulus through outlet 88. The helical baffles within the annulus increase the fluid velocity, thereby providing a high heat transfer coefficient which cools the walls of the tube and promotes improved heat transfer.

It will be understood that any suitable heat transfer tube may be employed in the fluid heater described above. For instance, as illustrated in FIG. 7, an unfired tube, such as the tube shown in FIG. 1*b*, may be employed where the fluid inlet end of the tube is in fluid communication with one or more external sources for the heat transfer medium. Alternatively, a fired tube, such as the tube shown in FIG. 1*a*, may be employed, the fired tube additionally comprising a burner secured to the fluid inlet end of the tube.

According to one embodiment of the fluid heater of FIG. 7, the tube 10 has an inner diameter of 4 inches and an outer diameter of 4¼ inches. The outer jacket tube 80 has an inner diameter of 4¾ inches , and an outer diameter of 5 inches. The outer baffle element 85 may be formed of a ¼ inch thick square or round rod or tube, with a helical pitch of about 1 to 2 inches per turn.

A further embodiment of the fluid heater/heat exchanger of the present invention is illustrated in FIGS. 8*a*–8*d*. In certain applications, it may be desirable to have the inlet and outlet of the jacket tube at the same end of the tube. Accordingly, the fluid heater of FIGS. 8*a*–8*d* comprises longitudinal baffles 89 that direct the flow of the fluid to be heated along the length of the baffle in longitudinal channels 90, first in one direction, and then in the opposite direction, and so on. If there are an even number of longitudinal channels around the circumference of the annulus, then the inlet 87 and outlet 88 may be located adjacent to each other at one end of the jacket tube.

Figure 8A:
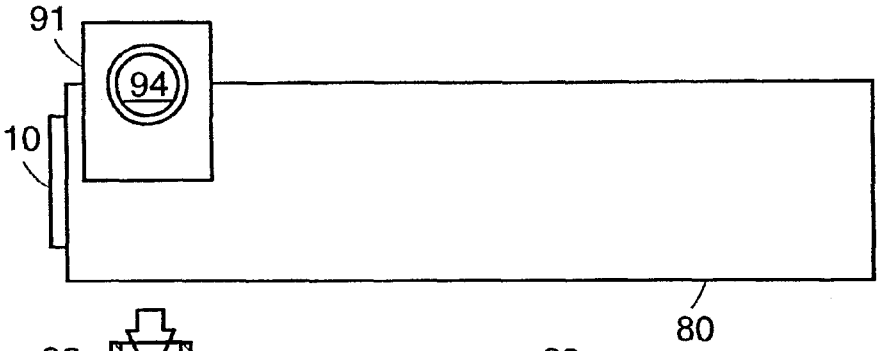
FIG. 8*a* is a side view of a fluid heater/heat exchanger with manifold body.
Figure 8C:
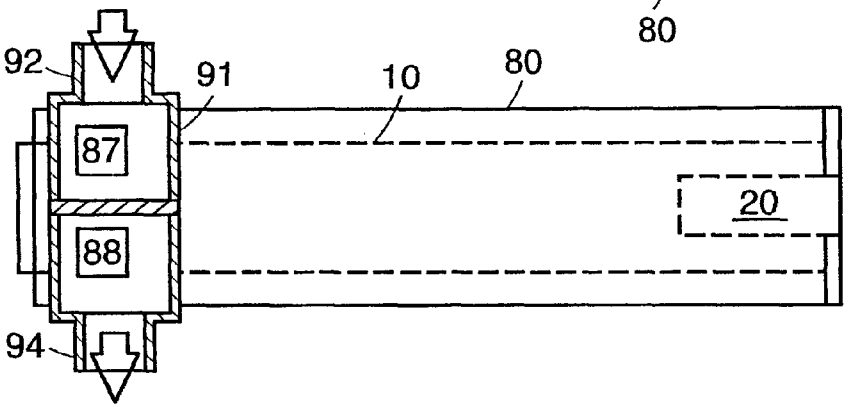
FIG. 8*c* is a cross-sectional top view of the fluid heater/heat exchanger with manifold body of FIG. 8*a;*
Figure 8D:
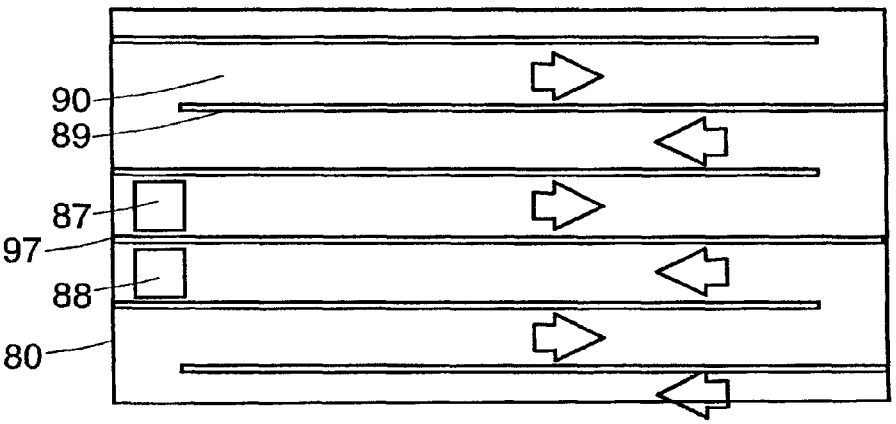
FIG. 8*d* is a developed view of the interior of the outer jacket tube and longitudinal baffles of the fluid heater/heat exchanger of FIG. 8*a;*
Figure 8B:
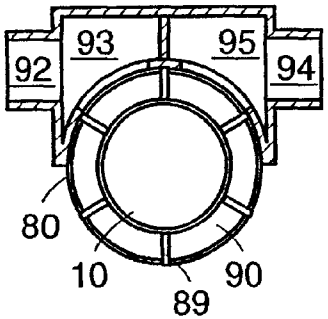
FIG. 8*b* is a cross-sectional front view of the fluid heater/heat exchanger with manifold body of FIG. 8*a;*

For example, FIG. 8*a* shows a side view of a heater comprising of an inner tubular member 10, an outer jacket tube 80, and a manifold body 91 secured to one end of the outer jacket tube. FIG. 8*b* illustrates this same heater in an end sectional view and FIG. 8*c* is a cut-away view of the manifold body 91. Manifold body 91 contains an inlet fitting 92 connected to inlet chamber 93 and outlet fitting 94 connected to outlet chamber 95. Inlet chamber 93 connects to inlet port 87 in the wall of outer jacket tube 80, and outlet chamber 95 connects to the outlet port 88 in the wall of outer jacket tube 80. The annular space between tubes 10 and 80 is separated by baffles 89 to form channels 90. The interior tube may, but need not, contain a burner 20, which, if employed, should be located at the end of the heater opposite the manifold body 91.

During operation, fluid to be heated flows from the inlet fitting 92 into the inlet chamber 93 of the manifold, and through the inlet port 87 into channel 90. The heated fluid is discharged from channel 90 through outlet port 88 into outlet chamber 95, exiting the manifold through outlet fitting 94. FIG. 8*d* is a developed view of the outer jacket tube 80 showing ports 87 and 88, which are in fluid communication with channel 90, and separated by center baffle 97. The baffles 89 are generally closed at alternate ends of the annulus to form a continuous flow path from inlet port 87 to outlet port 88. Center baffle 97 is closed at both ends to prevent short-circulating directly from inlet 87 to outlet 88. In this illustration, the baffles run parallel to one another, and are also parallel to the longitudinal axis of the tube. However, alternative configurations may also be employed. For example, the baffles may be pitched with respect to the longitudinal axis of the tube to promote a helical flow of the fluid to be heated.

For certain applications, for instance, for use as a low-temperature fluid heater, such as a swimming pool or spa heater, the interior tube 10 and end flanges 81 and 82 are comprised of metal, while outer jacket tube 80 and manifold body 91 are molded out of plastic. Baffles 89, 97 may either be made of metal and bonded to the interior tube 10, or may be made of plastic and molded separately or integrally with outer tube 80. Alternately, where conditions require a more durable construction, metal may be substituted for some or all of the plastic components. Additionally, the manifold body and/or the outer jacket tube may contain additional fittings and provisions for auxiliary components and controls, such as thermostats, pressure or flow switches, relief valves, and the like.

A fluid heater/heat exchanger according to the principles of the present invention, and in particular the fluid heater/heat exchanger illustrated in FIG. 7, may be employed as an engine heat recovery heat exchanger. For instance, the fluid heater/heat exchanger can be utilized as an efficient and robust exhaust heat recovery unit for engine driven heat pumps, chillers, and other engine driven systems. The engine heat recovery unit of the present invention generally comprises an internally pinned tube as described above, wherein the tube is in fluid communication with at least one combustion engine to receive hot engine exhaust gas. In this embodiment, the tube does not require an internal heat source, such as a burner, and a design similar to the tube illustrated in FIG. 1*b* may be employed.

In general, the engine heat recovery unit is constructed entirely of welded steel suitable for heating a fluid, such as a inhibited glycol coolant. In one embodiment, the unit measures approximately 16 inches long, and has an outer diameter (of the outer jacket tube) of about 6 inches. In this embodiment, the unit is appropriately sized for use with 30–40 hp engines. In general, the unit receives exhaust gas product from the engine(s) at a flow rate between 300 and 400 pounds per hour, and the gas is at a temperature of approximately 1300° F. At this temperature and a gas flow rate of 400 lb/h, the unit is able to recover in excess of 100,000 Btu per hour. Further specifications for the engine heat recovery unit are illustrated in the following chart:

| | | | |
|---|---|---|---|
| Gas Flow | 300 | 400 | lb/h |
| Engine Exhaust Temp. | 1300 | 1300 | deg. F. |
| Unit Exhaust Temp. | 270 | 300 | deg. F. |
| Heat Transfer | 80,447 | 106,377 | Btu per hour |
| Coolant Flow Rate | 9 | 12 | Gal. per minute |
| Inlet Temp. | 180 | 180 | deg. F. |
| Outlet Temp. | 200 | 200 | deg. F. |
| Gas Pressure Drop | 0.6 | 1.1 | Inches of Water Column |
| Coolant Pressure Drop | 0.6 | 1.0 | psi |
| Thermal Effectiveness | 92% | 89% | |
| Shell Outer Diameter | 6 | 6 | Inches |
| Shell Length | 16 | 16 | Inches |
| Dry Weight | 28 | 28 | lb. |

Figure 9:
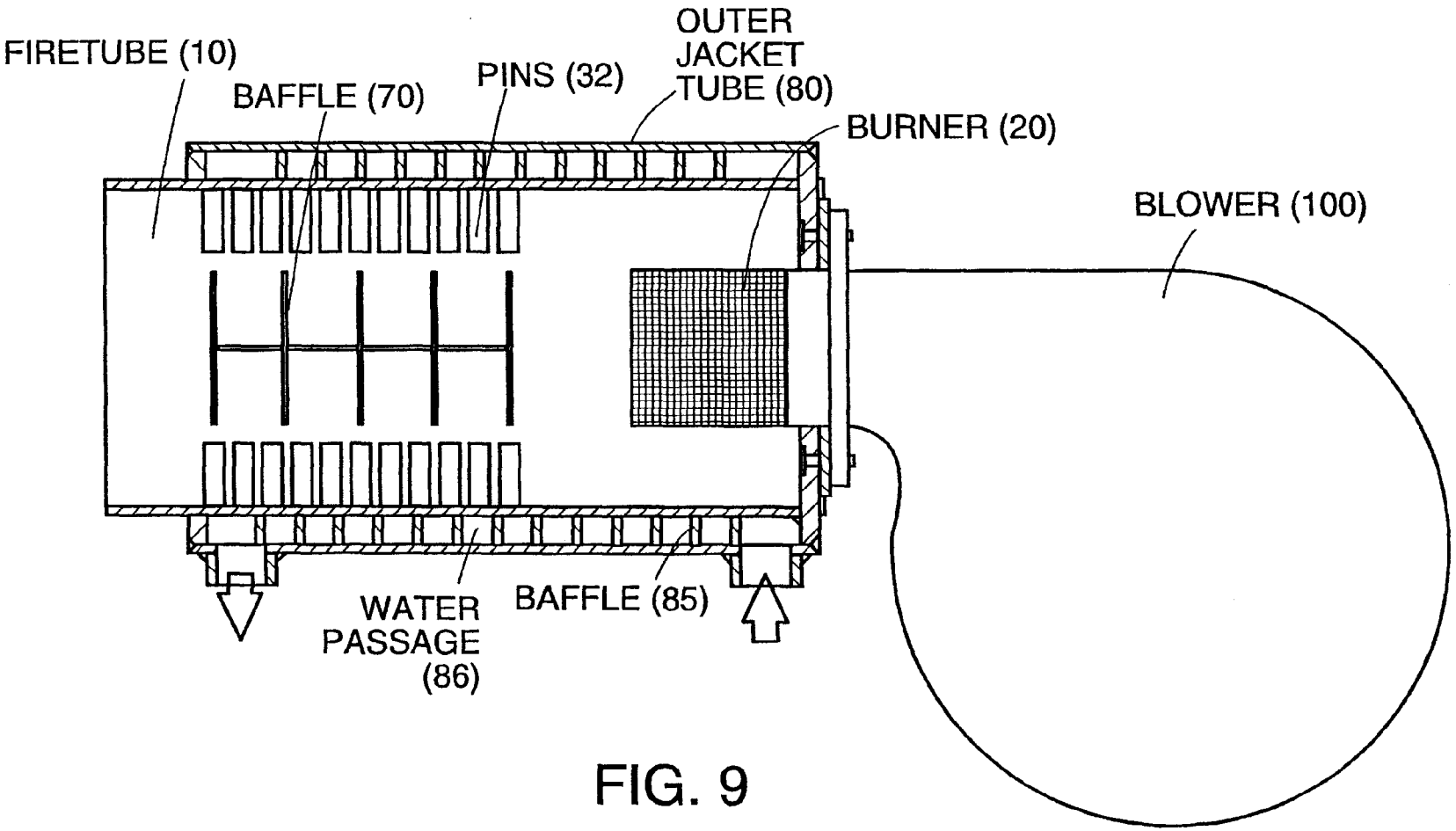
FIG. 9 is a cross-sectional side view of a gas-fired fluid heater according to the principles of the present invention.

Turning now to FIG. 9, a gas-fired fluid heater for use as a spa or pool heater is shown, the heater generally comprising an outer jacket tube 80 surrounding a central firetube 10. The firetube contains an internal burner 20, internal pin elements 32, and an internal blocking member, which in this example a baffle array 70. The firetube is approximately 4 to 5 inches in diameter, and the jacket tube has a diameter that is approximately one inch larger than the firetube. The wetted parts of the firetube and jacket are made of corrosion resistant material, such as copper, stainless steel, coated carbon steel, and/or plastic. No refractory insulation is required, and external jacket insulation is optional.

In operation, a premixed burner 20, powered by a combustion air blower 100, fires inside the tube 10. As the burner fires, a liquid jacket surrounds the tube in the annulus formed between the exterior of the firetube and the interior of the outer jacket tube. One or more fluid-side baffles, which in this example comprises a single helical baffle 85, forces the water to flow in a helical path around the firetube.

An alternative configuration is illustrated in FIGS. 10*a*–10*d*. According to this embodiment, the inlet and outlet ports of the jacket tube are located at the same end of the tube, and the fluid-side baffles comprise longitudinal baffles 89 that direct the flow of the fluid to be heated through longitudinal channels running the length of the tube in alternating directions. A similar longitudinal baffle arrangement is illustrated in further detail in FIGS. 8*a*–8*d*. The embodiment illustrated in FIG. 10*a* additionally comprises fitting bosses 101 in the outer tube for mounting operating and safety controls.

Figure 10A:
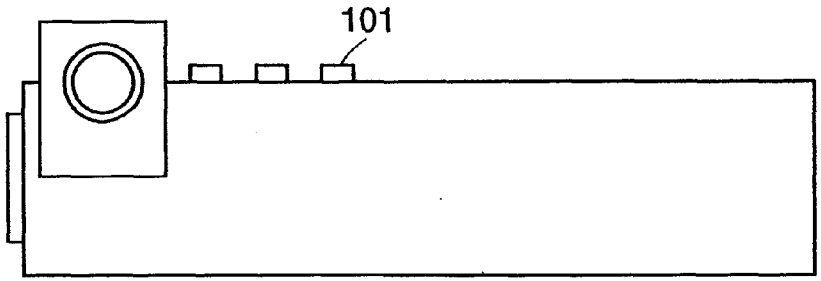
FIG. 10*a* is a side view of an alternative embodiment of the gas-fired fluid heater of the present invention.
Figure 10C:
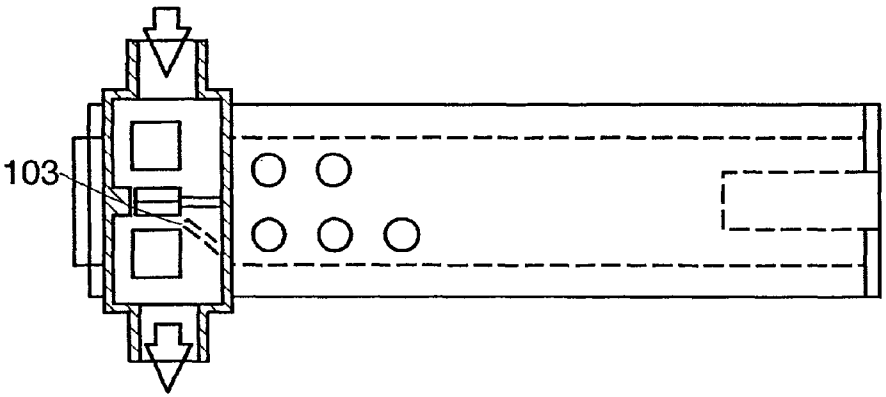
FIG. 10*c* is a cross-sectional top view of the gas-fired fluid heater of FIG. 10*a;*
Figure 10D:
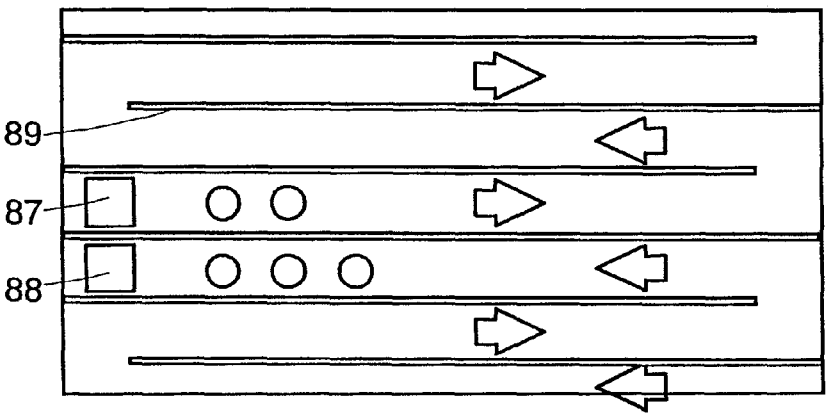
FIG. 10*d* is a developed view of the interior of the outer jacket tube and longitudinal baffles of the gas-fired fluid heater of FIG. 10*a.*
Figure 10B:
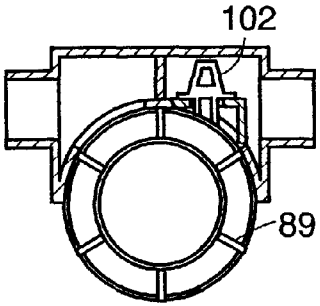
FIG. 10*b* is a cross-sectional front view of the gas-fired fluid heater of FIG. 10*a;*

FIG. 10*b* shows a cross-section of the concentric vessel tubes and the inlet/outlet manifold. The baffles may be metal or plastic. The firetube and at least the flange at the burner end must be metal. The outer shell can be metal welded to the firetube, or it can be plastic removably sealed to flange(s) welded to the inner shell.

The inlet/outlet manifold is located at the end of the heater opposite the burner. The manifold may be plastic, and can be O-ring sealed to the outer tube, or integral with a plastic outer tube. The manifold may additionally comprise a thermal governor 102 in the outlet chamber 95, and a spring-loaded internal by-pass valve 103 in the bulkhead separating the inlet and outlet ports, as illustrated in FIG. 10*c*. The bypass valve may be, for instance, a sliding poppet or a swinging gate valve supported by a leaf or torsion spring.

FIG. 10*d* is a developed view of the annulus showing the longitudinal baffles 89, inlet and outlet ports 87, 88, and sensor fittings 104. If metal, the baffles may be welded or brazed to the firetube. If plastic, they may be a separate assembly, or if the outer tube is plastic, they can be formed integrally with the shell. The baffles may also be helical. A dual-pitch helix permits the fluid inlet and outlet to be located at the same end of the heater, but at the expense of greater baffle leakage since the differential pressure is higher. An operating control device and pressure switch may be mounted on the outer tube immediately downstream of the inlet 87. Similarly, a pressure relief valve, automatic gas shutoff switch, and high limit switch may be mounted immediately upstream of the outlet port 88.

In general, the fluid heater as described above has an outer tube diameter of 5 to 6 inches, and is approximately 24 inches long. It can operate at 82% to 84% efficiency at an input of 100,000 Btu/h. Greater inputs require progressively larger diameters. For instance, the diameter of a 150,000 Btu/h heater is approximately 2 inches larger.

In a tubular member having a fluid inlet end and a fluid outlet end, a plurality of pins secured to the interior wall at a distance longitudinally from the burner, the pins projecting inwardly to define an interior core area of the tubular member, and a blocking member disposed in the interior core area, a method for heating a fluid is also disclosed. The method comprises supplying a high-temperature fluid to the fluid inlet end of the tubular member, permitting the high-temperature fluid to flow through the tubular member to the fluid outlet end, and discharging the high-temperature fluid from the fluid outlet end of the tube.

The method further comprises, in a concentric shell disposed around the exterior of the tubular member, the concentric shell secured to the tubular member at the fluid inlet end and the fluid outlet end, and the interior of the concentric shell and the exterior of the tubular member defining an annulus for containing a fluid to be heated, admitting a fluid to be heated into the annulus, permitting the fluid to contact the exterior wall of the tubular member, and discharging heated fluid from the annulus. The method operates by transferring heat from the hot fluid to the pins and the interior wall of the tubular member, which in turn heats the exterior wall of the tube, and ultimately the fluid contained in the annulus. According to certain embodiments, at least one exterior baffle, including a single helical baffle, or a plurality of longitudinal baffles defining longitudinal flow channels, may be employed to direct the fluid to be heated along a fluid flow path within the annulus.

In accordance with a further embodiment, the blocking member of the method described above comprises a core plug. The core plug is disposed in the interior core area and contacts the tips of the pins. As a result, the hot fluid is forced to flow through the area of the tube containing the pins. In one embodiment, the core plug comprises a truncated cone at the end facing the burner, thus gradually forcing the fluid to flow through the pinned area.

In a still further embodiment of the above-described method, the blocking member comprises a series of metal baffles disposed longitudinally along the interior core area of the tube, whereby the metal baffles periodically force the hot fluid to flow through the pinned area. The metal baffles may totally block the interior core area of the tube, or may only partially block the interior core area.

While this invention has been particularly shown and described with references to preferred embodiments thereof, it will be understood by those skilled in the art that various changes in form and details may be made therein without departing from the scope of the invention encompassed by the appended claims.

What is claimed is:

1. A heat exchanger comprising:

a tubular member having a fluid inlet end and a fluid outlet end;

a plurality of closely-spaced pins having a base end bonded to the interior wall of the tubular member and a tip end facing the interior of the tubular member, the tip ends of the pins defining an interior core area of the tubular member, wherein the aspect ratio of a cross section of each pin is approximately equal to unity; and a blocking member disposed in the interior core area of the tubular member.

2. The heat exchanger according to claim 1 wherein the blocking member comprises a core plug.

3. The heat exchanger according to claim 2 wherein the core plug is a truncated cone having a larger diameter base end and a smaller diameter tip end, the tip end facing the fluid inlet end of the tubular member.

4. A heat exchanger comprising:

a tubular member having a fluid inlet end and a fluid outlet end;

a plurality of closely-spaced pins having a base end bonded to the interior wall of the tubular member and a tip end facing the interior of the tubular member, the tip ends of the pins defining an interior core area of the tubular member; and a blocking member disposed in the interior core area of the tubular member, wherein the blocking member comprises a plurality of metal baffles disposed longitudinally along the interior core area of the tubular member, the baffles oriented to obstruct at least a portion of a heat transfer fluid propagating through the interior core area of the tubular member, and wherein adjacent metal baffles define a chamber of the interior core area of the tubular member.

5. The heat exchanger according to claim 4 wherein each metal baffle is shaped to obstruct some flow of the heat transfer fluid through the interior core area of the tubular member and permit some flow into a proximate chamber along a fluid flow path.

6. The heat exchanger according to claim 4 wherein the plurality of baffles comprises a single piece of sheet metal that is cut and folded to form both baffles and metal strips connecting adjacent baffles.

7. The heat exchanger according to claim 1 wherein the pins have a height to diameter ratio of approximately two.

8. The heat exchanger according to claim 1 wherein the pins are constructed from carbon steel.

9. The heat exchanger according to claim 1 wherein the pins are spaced approximately equidistant from each adjacent pin at their tip ends.

10. The heat exchanger according to claim 9 wherein the minimum clearance space between the tips of each adjacent pin is approximately one-eighth inch.

11. The heat exchanger according to claim 1 wherein the plurality of pins comprises rows of pins bonded to the tube around an interior circumference of the tube.

12. The heat exchanger according to claim 11 wherein the rows of pins comprise alternating rows of pins in circular arrays such that each pin is positioned in between the pins of adjacent rows.

13. The heat exchanger according to claim 1 wherein the plurality of pins comprises a helical array of pins.

14. A heat exchanger comprising:

a tubular member having a fluid inlet end and a fluid outlet end;

a plurality of closely-spaced pins having a base end bonded to the interior wall of the tubular member and a tip end facing the interior of the tubular member, the tip ends of the pins defining an interior core area of the tubular member;

a blocking member disposed in the interior core area of the tubular member; and a shell attached concentrically around the tubular member to form an annulus between the shell and the exterior of the tubular member, the shell additionally comprising a fluid inlet for admitting a fluid to the annulus, and a fluid outlet for discharging fluid from the annulus.

15. A heat exchanger comprising:

a tubular member having a fluid inlet end and a fluid outlet end;

a plurality of closely-spaced pins having a base end bonded to the interior wall of the tubular member and a tip end facing the interior of the tubular member, the tip ends of the pins defining an interior core area of the tubular member;

a blocking member disposed in the interior core area of the tubular member; and an outer jacket tube containing the tubular member, the outer jacket tube secured to the tubular member at the fluid inlet end and the fluid outlet end to produce an annulus between the exterior of the tubular member and the interior of the outer jacket tube;

an inlet port for admitting a fluid into the annulus;

an outlet port for discharging fluid from the annulus; and at least one baffle element disposed within the annulus and defining at least one channel in the annulus for the flow of fluid.

16. The heat exchanger according to claim 15 wherein the at least one baffle element comprises a baffle wound around the outside of the tubular member in a helical fashion.

17. The heat exchanger according to claim 15 wherein the at least one baffle element comprises a plurality of longitudinal baffles defining longitudinal channels for the flow of fluid within the annulus.

18. The heat exchanger according to claim 17 wherein the longitudinal baffles direct the flow of the fluid through longitudinal channels running the length of the tubular member and the direction of the fluid flow alternates between adjacent channels.

19. The heat exchanger according to claim 17 wherein the inlet and outlet ports are located at the same end of the outer jacket tube.

20. The heat exchanger according to claim 19, additionally comprising a manifold body secured to the outer jacket tube and containing the inlet and outlet ports.

21. A heater comprising:

a tubular member having a fluid inlet end and a fluid outlet end;

a heat source producing a high-temperature fluid in fluid communication with the fluid inlet end of the tubular member;

a plurality of closely-spaced pins having a base end bonded to the interior wall of the tubular member and a tip end facing the interior of the tubular member, the tip ends of the pins defining an interior core area of the tubular member, wherein the aspect ratio of a cross section of each pin is approximately equal to unity; and a blocking member disposed in the interior core area of the tubular member.

22. The heater according to claim 21 wherein the heat source comprises a burner secured to the fluid inlet end of the tubular member.

23. The heater according to claim 21 wherein the heat source comprises an external heat source in fluid communication with the fluid inlet end of the tubular member.

24. A heater comprising:

a tubular member having a fluid inlet end and a fluid outlet end;

a heat source producing a high-temperature fluid in fluid communication with the fluid inlet end of the tubular member;

a plurality of closely-spaced pins having a base end bonded to the interior wall of the tubular member and a tip end facing the interior of the tubular member, the tip ends of the pins defining an interior core area of the tubular member;

a blocking member disposed in the interior core area of the tubular member; and a shell attached concentrically around the tubular member to form an annulus between the shell and the exterior of the tubular member, the shell additionally comprising a fluid inlet for admitting a fluid to be heated into the annulus, and a fluid outlet for discharging heated fluid from the annulus.

25. A heater comprising:

a tubular member having a fluid inlet end and a fluid outlet end;

a heat source producing a high-temperature fluid in fluid communication with the fluid inlet end of the tubular member;

a plurality of closely-spaced pins having a base end bonded to the interior wall of the tubular member and a tip end facing the interior of the tubular member, the tip ends of the pins defining an interior core area of the tubular member;

a blocking member disposed in the interior core area of the tubular member; and an outer jacket tube containing the tubular member, the outer jacket tube secured to the tubular member at the fluid inlet end and the fluid outlet end to produce an annulus between the exterior of the tubular member and the interior of the outer jacket tube;

an inlet port for admitting a fluid to be heated into the annulus;

an outlet port for discharging heated fluid from the annulus; and at least one baffle element disposed within the annulus and defining at least one channel in the annulus for the flow of fluid.

26. The heater according to claim 25, wherein the at least one baffle element comprises a baffle wound around the outside of the tubular member in a helical fashion.

27. The heater according to claim 25, wherein the at least one baffle element comprises a plurality of longitudinal baffles defining longitudinal channels for the flow of fluid within the annulus.

28. The heater according to claim 27 wherein the longitudinal baffles direct the flow of the fluid through longitudinal channels running the length of the tubular member and the direction of the fluid flow alternates between adjacent channels.

29. The heater according to claim 27 wherein the inlet and outlet ports are located at the same end of the outer jacket tube.

30. The heater according to claim 29, additionally comprising a manifold body secured to the outer jacket tube and containing the inlet and outlet ports.

31. A heater comprising:

a tubular member having a fluid inlet end and a fluid outlet end;

heating means for producing hot fluid in fluid communication with the fluid inlet end of the tubular member;

a pinned area of the tubular member, the pinned area comprising a plurality of pins having a base end bonded to the interior wall of the tubular member and a tip end facing the interior of the tubular member, the tip ends of the pins defining an interior core area of the tubular member, wherein the aspect ratio of a cross section of each pin is approximately equal to unity; and blocking means disposed in the interior core area of the tubular member for obstructing at least a portion of a fluid flow in the interior core area of the tubular member.

* * * * *